US010559241B2

(12) United States Patent
Noh et al.

(10) Patent No.: US 10,559,241 B2
(45) Date of Patent: Feb. 11, 2020

(54) DISPLAY DEVICE AND METHOD FOR DISPLAYING IMAGE USING THE SAME

(71) Applicant: Samsung Display Co., Ltd., Yongin-si, Gyeonggi-do (KR)

(72) Inventors: Jin Woo Noh, Yongin-si (KR); Jun Gyu Lee, Yongin-si (KR); Byung Ki Chun, Yongin-si (KR)

(73) Assignee: Samsung Display Co., Ltd. (KR)

( * ) Notice: Subject to any disclaimer, the term of this patent is extended or adjusted under 35 U.S.C. 154(b) by 66 days.

(21) Appl. No.: 15/666,360

(22) Filed: Aug. 1, 2017

(65) Prior Publication Data

US 2018/0068603 A1 Mar. 8, 2018

(30) Foreign Application Priority Data

Sep. 6, 2016 (KR) ..... 10-2016-0114612

(51) Int. Cl.
*G09G 3/00* (2006.01)
*G09G 3/20* (2006.01)

(52) U.S. Cl.
CPC ..... *G09G 3/007* (2013.01); *G09G 3/2092* (2013.01); *G09G 2310/027* (2013.01); *G09G 2320/0257* (2013.01)

(58) Field of Classification Search
CPC ..... G09G 3/007; G09G 3/20; G09G 3/2092; G09G 2310/027; G09G 2320/0257; G09G 2340/0407
See application file for complete search history.

(56) References Cited

U.S. PATENT DOCUMENTS

2012/0014453 A1* 1/2012 Kawai ..... H04N 5/145 375/240.16
2014/0016005 A1* 1/2014 Kishima ..... H04N 5/367 348/246
2016/0321974 A1 11/2016 Chun et al.
2016/0329008 A1 11/2016 Chun et al.

FOREIGN PATENT DOCUMENTS

KR 10-2016-0130027 A 11/2016
KR 10-2016-0132170 A 11/2016

* cited by examiner

*Primary Examiner* — Sahlu Okebato
(74) *Attorney, Agent, or Firm* — Innovation Counsel LLP

(57) ABSTRACT

A method for displaying an image using a display device includes generating first image data corresponding to a first image displayed in a first area in an image display area, differently determining the size of a second area in which a second image is displayed corresponding to shift information of a preset image, generating second image data corresponding to the second image, based on the first image data, generating a data signal, based on the first image data or the second image data, and emitting light with a luminance corresponding to the data signal.

20 Claims, 8 Drawing Sheets

DISPLAY DEVICE AND METHOD FOR DISPLAYING IMAGE USING THE SAME

RELATED APPLICATIONS

The present application claims priority to Korean Patent Application No. 10-2016-0114612, filed on Sep. 6, 2016, in the Korean Intellectual Property Office, the entire disclosure of which is incorporated by reference herein.

BACKGROUND

1. Field

An aspect of the present disclosure relates to a display device and a method for displaying an image using the same.

2. Description of the Related Art

Recently, various kinds of display devices such as organic light emitting display devices, liquid crystal display devices, and plasma display devices have been widely used.

If such a display device outputs a specific image or letter for a long period of time, a specific pixel becomes degraded, and therefore, an afterimage may be generated.

In order to solve the above-described problem, a technique (referred to as a pixel shift technique) is employed of shifting an image on a display panel for every certain period to be displayed. If an image is shifted on the display panel for every certain period to be displayed, the same data is prevented from being output to a specific pixel for a long period of time, thereby preventing the degradation of the specific pixel.

SUMMARY

Embodiments provide a display device and a method for displaying an image using the same, which can effectively prevent the generation of an afterimage caused by an image fixedly displayed in a specific area.

According to an aspect of the present disclosure, there is provided a method for displaying an image using a display device, the method including: generating first image data corresponding to a first image displayed in a first area in an image display area; differently determining the size of a second area in which a second image is displayed corresponding to shift information of a preset image; generating second image data corresponding to the second image, based on the first image data; generating a data signal, based on the first image data or the second image data; and emitting light with a luminance corresponding to the data signal.

In differently determining the size of the second area, the second area may be determined such that the first image is shifted to the second image, the shifting of the first image corresponding to a shift amount and a shift direction of an image included in the shift information.

In differently determining the size of the second area, the second area may be determined such that a center of the first area and a center of the second area are formed on a same linear axis.

The first area may have a larger size than the second area.

A portion of the first area may overlap with the second area.

A black image is displayed in an area of the first area, which does not overlap with the second area.

When the first area and the second area have quadrangular shapes, the ratios of lateral lengths to longitudinal lengths of the respective first and second areas may be equal to each other.

When the first area and the second area have quadrangular shapes, the ratios of lateral lengths to longitudinal lengths of the respective first and second areas may be different from each other.

Some corners surrounding the first area may overlap with some corners surrounding the second area.

The method may further include setting a fixed area in the first area using the first image data.

In differently determining the size of the second area, at least a partial area of the image display area except the fixed area may be determined as the second area.

In setting the fixed area, an area having no change in image by comparing a current frame image with a previous frame image may be set as the fixed area.

According to an aspect of the present disclosure, there is provided a display device including: a display panel configured to include a first area in which a first image is displayed and a second area in which a second image is displayed; an image corrector configured to differently determine the size of the second area for every frame, and generate second image data corresponding to the second image using first image data corresponding to the first image; and a data driver configured to generate a data signal, based on the first image data and the second image data.

The image corrector may include: a frame data counter configured to count a number of input times of frames; a shift determiner configured to determine a shift amount and a shift direction of an image based on a preset reference such that the first image is shifted to the second image to be displayed; an area determiner configured to determine the first area and determine the second area corresponding to the shift amount and the shift direction of the image; and an image data generator configured to generate the second image data using the first image data.

The area determiner may determine the size of the second area to be smaller than that of the first area.

The area determiner may determine the second area such that the second area overlaps with at least a portion of the first area.

The area determiner may determine the second area at a rate equal to that of corners surrounding the first area.

The area determiner may determine the second area such that some corners surrounding the first area and some corners surrounding the second area overlap with each other.

The area determiner may set a fixed area in the first area using the first image data, and determine, as the second area, at least a partial area of an image display area except the fixed area.

When the display panel receives the data signal generated based on the second image data from the data driver, a black image may be displayed in arest of the second area.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
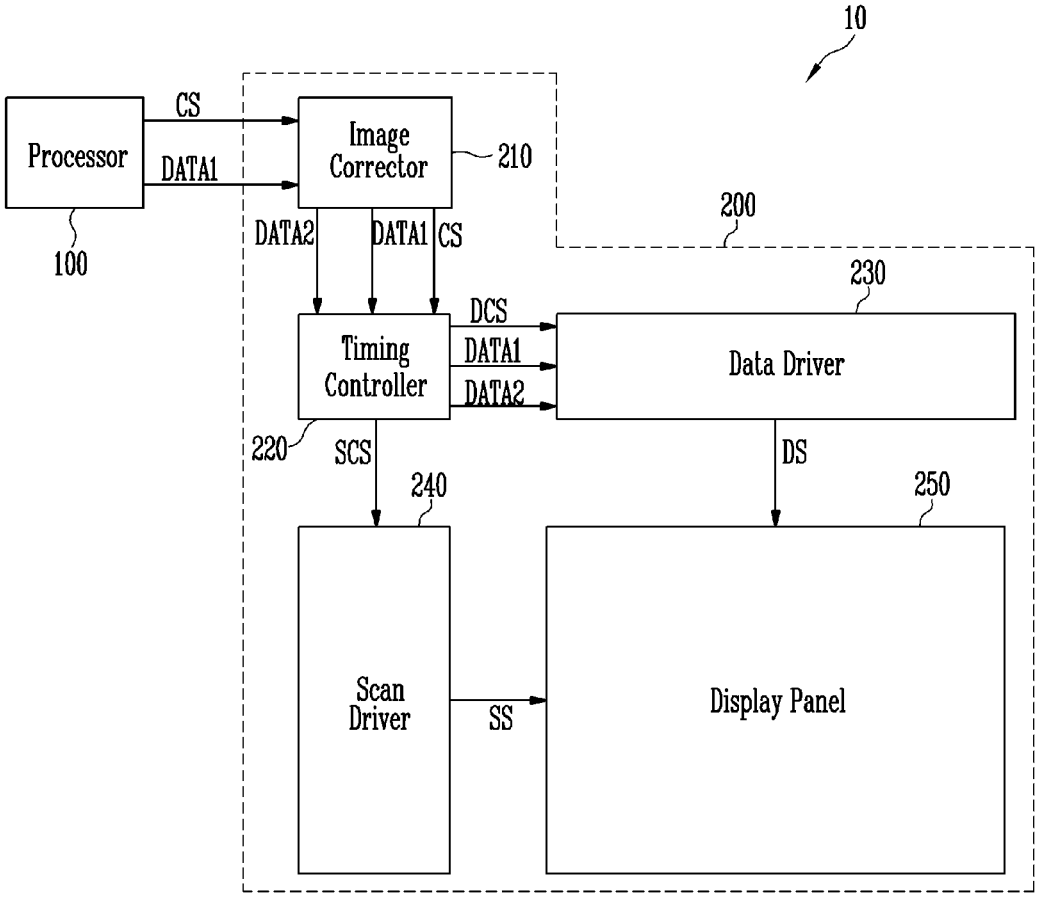
FIG. 1 is a schematic block diagram of a display device according to an embodiment of the present disclosure.

The specific structural or functional description disclosed herein is merely illustrative for the purpose of describing embodiments according to the concept of the present disclosure. The embodiments according to the concept of the present disclosure can be implemented in various forms, and cannot be construed as limited to the embodiments set forth herein.

The embodiments according to the concept of the present disclosure can be variously modified and have various shapes. Thus, the embodiments are illustrated in the drawings and are intended to be described herein in detail. However, the embodiments according to the concept of the present disclosure are not construed as limited to specified disclosures, and include all changes, equivalents, or substitutes that do not depart from the spirit and technical scope of the present disclosure.

While terms such as "first" and "second" may be used to describe various components, such components must not be understood as being limited to the above terms. The above terms are used only to distinguish one component from another. For example, a first component may be referred to as a second component without departing from the scope of rights of the present disclosure, and likewise a second component may be referred to as a first component.

The terms used in the present application are merely used to describe particular embodiments, and are not intended to limit the present disclosure. Singular forms in the present disclosure are intended to include the plural forms as well, unless the context clearly indicates otherwise. It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

So far as not being differently defined, all terms used herein including technical or scientific terminologies have meanings that they are commonly understood by those skilled in the art to which the present disclosure pertains. The terms having the definitions as defined in the dictionary should be understood such that they have meanings consistent with the context of the related technique. So far as not being clearly defined in this application, terms should not be understood in an ideally or excessively formal way.

Hereinafter, exemplary embodiments of the present disclosure will be described in detail with reference to the accompanying drawings.

Figure 2:
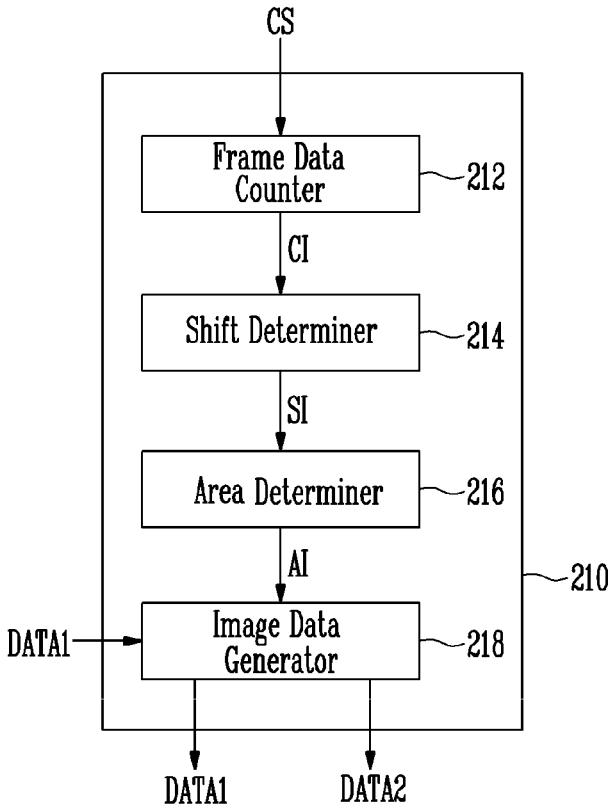
FIG. 2 is a schematic block diagram of an image corrector shown in FIG. 1.

FIG. 1 is a schematic block diagram of a display device according to an embodiment of the present disclosure. FIG. 2 is a schematic block diagram of an image corrector shown in FIG. 1.

Referring to FIGS. 1 and 2, the display device 10 may include a processor 100 and a display unit 200.

In some embodiments, the display device 10 may be any one of a personal computer (PC), a smart phone, a tablet PC, a mobile Internet device (MID), an Internet tablet, an Internet of things (IoT) device, an Internet of everything (IoE) device, a desktop computer, a laptop computer, a workstation computer, and a personal digital assistant (PDA), but the present disclosure is not limited thereto.

The processor 100 may generate first image data DATA1 and a control signal CS for controlling driving of the display unit 200 to be supplied to the display unit 200.

In some embodiments, the processor 100 may be implemented as a processor capable of controlling an operation of an application processor (AP), a mobile AP, a central processing unit (CPU), a graphic processing unit (GPU), or the display unit 200, but the present disclosure is not limited thereto.

The display unit 200 may include an image processor 210, a timing controller 220, a data driver 230, a scan driver 240, and a display panel 250.

The image corrector 210 may generate second image data DATA2, based on the first image data DATA1. Here, the first image data DATA1 refers to an image data corresponding to a first image displayed in a first area in an image display area of the display panel 250, and the second image data DATA2 refers to an image data corresponding to a second image displayed in a second area in the image display area. In addition, the second image refers to an image displayed as the first image is shifted by a pixel shift.

In FIG. 1, it is illustrated that the image corrector 210 is implemented inside the display unit 200. However, in some embodiments, the image corrector 210 may be implemented inside the processor 100, or may be implemented inside the timing controller 220.

The image corrector 210 may include a frame data counter 212, a shift determiner 214, an area determiner 216, and an image data generator 218.

The frame data counter 212 may count a number of input times of frames, based on the first image data DATA1, and generate frame information CI including the number of input times of frames.

In some embodiments, the frame data counter 212 may count a number of input times of frames using the control signal CS. For example, the frame data counter 212 may count a number of input times of frames by determining a number of input times of vertical synchronization signals included in the control signal CS.

The shift determiner 214 may determine a shift direction and shift amount of an image using the frame information CI, and generate shift information SI of the image, which includes the determined shift direction and shift amount of the image. For example, the shift determiner 214 may determine an x-axis shift direction, y-axis shift direction, x-axis shift amount, and y-axis shift amount of the image, corresponding to the number of input times of frames.

In some embodiments, the shift determiner 214 may determine a shift direction and shift amount of an image using a lookup table (not shown) including the shift direction and shift amount of the image predetermined corresponding to the number of input times of frames.

The area determiner 216 may determine a second area in which a second image is displayed corresponding to the shift direction and shift amount of the image included in the shift information SI of the image. The area determiner 216 may further generate area information AI on the second area.

For example, if the shift information SI of an image includes an x-axis shift direction, x-axis shift amount, y-axis shift direction, and y-axis shift amount of the image, the area determiner 216 may determine a second area shifted along the x-axis and y-axis directions from the first area, based on the x-axis shift direction, x-axis shift amount, y-axis shift direction, and y-axis shift amount.

In this case, the area determiner 216 may determine the second area by reducing or enlarging the first area. That is, the second area may have a smaller or larger size than the first area, and at least portions of the first area and the second area may overlap with each other.

In addition, the area determiner 216 may differently determine the size of the second area for every frame. For example, when the first image data DATA1 of a first frame is provided to the image corrector 210, the area determiner 216 may determine a second area corresponding to a first size. When the first image data DATA1 of a second frame is provided to the image corrector 210, the area determiner 216 may determine a second area corresponding to a second size different from the first size.

According to the embodiment of the present disclosure, the image corrector 210 can shift an image fixedly displayed in a specific area by adjusting the size of an image displayed for every frame. Accordingly, the generation of an afterimage in the specific area can be effectively prevented.

If the shift information SI of the image includes information that allows the image not to be shifted, the area determiner 216 does not determine the second area but may generate information AI on the first area.

The image data generator 218 may generate second image data DATA2 using the area information AI, based on the first image data DATA1, so that a first image displayed in the first area is shifted to the second area to be displayed as the second image.

In some embodiments, the image data generator 218 may generate the second image data DATA2 in units of pixel lines, based on the first image data DATA1. For example, the image corrector 210 may store the first image data DATA1 provided from the processor 100 in a line memory, and the image data generator 218 may generate the second image data DATA2 in units of pixel lines by reading the first image data DATA1 from the line memory.

If the area information AI includes information on the first area, the image data generator 218 does not separately generate the second image data DATA2, but may provide the first image data DATA1 to the timing controller 220.

The timing controller 220 may receive the control signal CS and the first or second image data DATA1 or DATA2 from the image corrector 210, and generate a scan control signal SCS and a data control signal DCS.

The data driver 230 may generate a data signal DS using the first or second image data DATA1 or DATA2 and the data control signal DCS. The data driver 230 may provide the data signal DS to pixels through data lines (not shown).

The scan driver 240 may generate a scan signal SS using the scan control signal SCS. The scan driver 240 may provide the scan signal SS to pixels through scan lines (not shown).

The display panel 250 includes pixels, and may be implemented as an organic light emitting display panel, a liquid crystal display panel, a plasma display panel, or the like. However, the present disclosure is not limited thereto.

If the scan signal SS is supplied to the scan lines, then pixels on a pixel row, selected in a horizontal unit, may receive the data signal DS supplied from the respective data lines, and emit light with a predetermined luminance.

Figure 3:
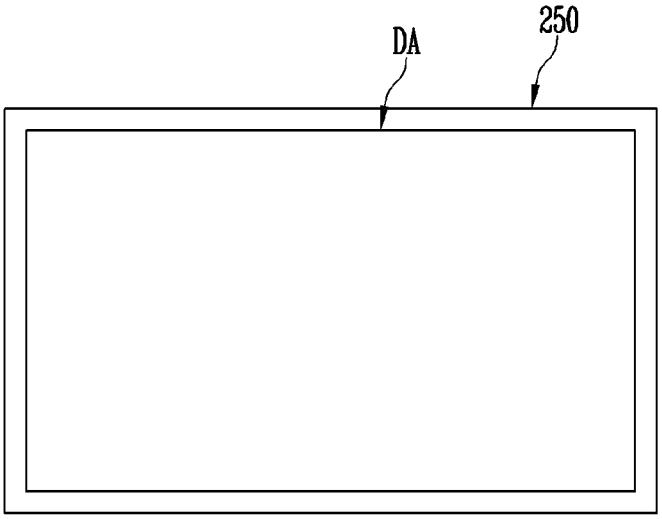
FIG. 3 is a conceptual diagram illustrating an image display area of a display panel according to the embodiment of the present disclosure.
Figure 4:
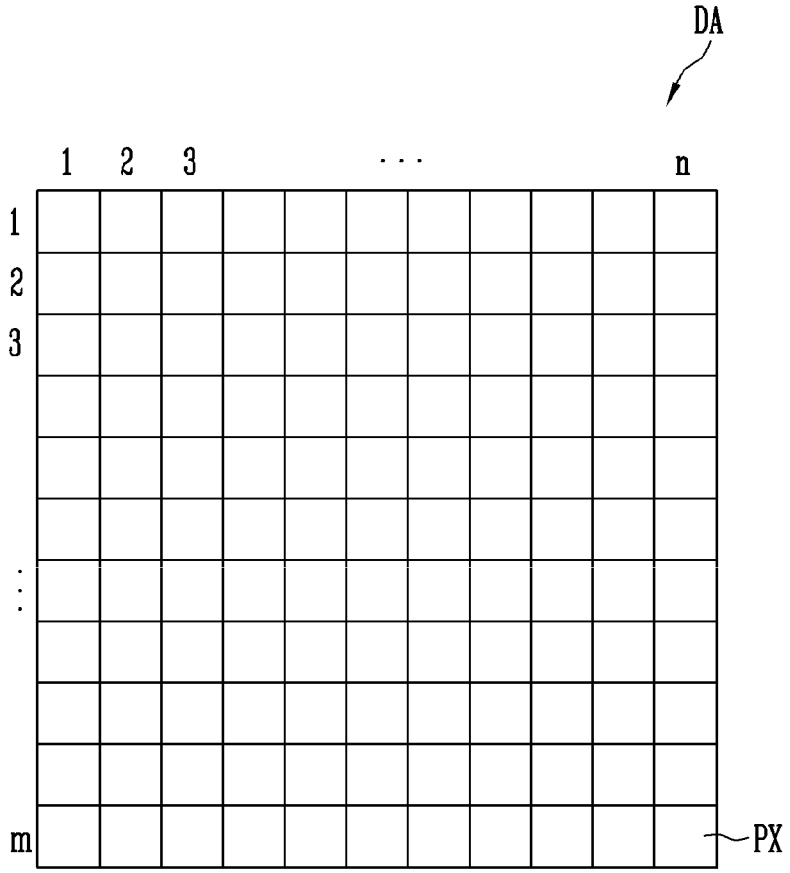
FIG. 4 is a conceptual diagram illustrating pixels arranged in the image display area shown in FIG. 3.

FIG. 3 is a conceptual diagram illustrating an image display area of the display panel according to the embodiment of the present disclosure. FIG. 4 is a conceptual diagram illustrating pixels arranged in the image display area shown in FIG. 3.

Referring to FIG. 3, the display panel 250 may include an image display area DA in which an image can be displayed. A user of the display panel 250 can view an image displayed in the image display area DA.

The image display area DA may include a plurality of pixels that emit light with a luminance corresponding to the data signal DS.

Referring to FIG. 4, the image display area DA may include pixels PX constituting an n×m matrix structure. For example, if the resolution of the display panel 250 is 1920×1080, n may be 1920 and m may be 1080.

Each of the pixels PX may receive the data signal DS generated based on the first or second image data DATA1 or DATA2 to emit light with a predetermined luminance.

Figure 5:
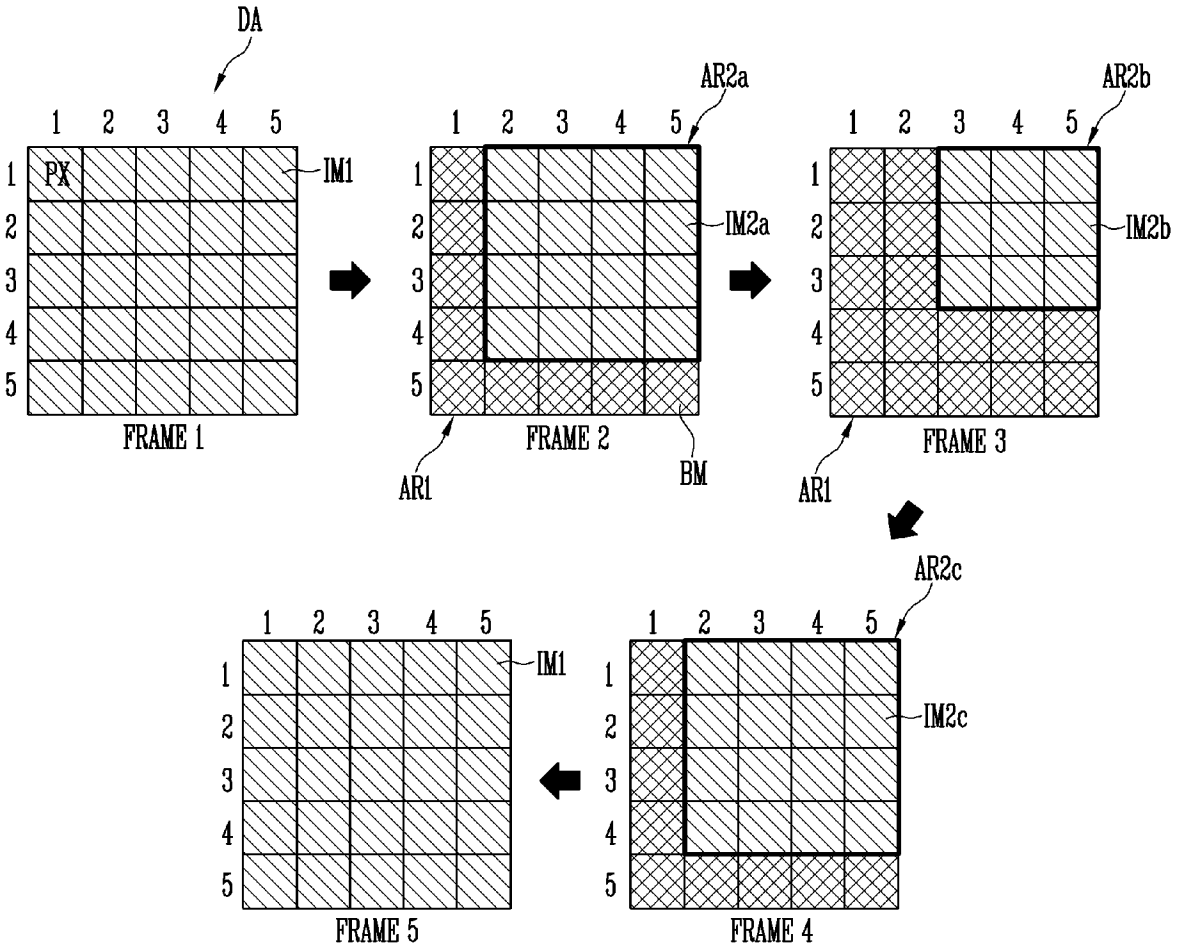
FIG. 5 is a conceptual diagram illustrating a method for displaying an image using the display device according to the embodiment of the present disclosure.

FIG. 5 is a conceptual diagram illustrating a method for displaying an image using the display device according to an embodiment of the present disclosure.

Although pixels PX constituting a 5×5 matrix structure is illustrated in FIG. 5, this is merely an embodiment for easily describing an image displayed by the pixels PX constituting the n×m matrix structure, and the present disclosure is not limited to a 5×5 matrix structure. In addition, a first area AR1 shown in FIG. 5 may mean the whole of an image display area DA, and second areas AR2*a* and AR2*b* may mean portions of the image display area DA.

Referring to FIG. 5, there are illustrated frame images FRAME 1 to FRAME 5 sequentially displayed in the image display area DA. Each of the frame images FRAME 1 to FRAME 5 is displayed corresponding to the data signal DS generated based on the first or second image data DATA1 or DATA2.

First, a method for displaying a first frame image FRAME 1 of a first frame will be described. When the image corrector 210 receives first image data DATA1 and a control signal CS from the processor 100, the frame data counter 212 may determine information that the first image data DATA1 is the first frame by using the control signal (e.g., a vertical synchronization signal), and generate frame information CI on the first frame.

If it is previously determined that an image of the first frame is not shifted, the shift determiner 214 may generate shift information SI of the image including non-shift information such that the image is not shifted.

The area determiner 216 may generate area information AI on a first area AR1.

The image data generator 218 may supply the first image data DATA1 to the timing controller 220, corresponding to the area information AI. The timing controller 220 may supply the first image data DATA1 to the data driver 230. The data driver 230 may provide a data signal DS generated based on the first image data DATA1 to pixels PX arranged in the first area AR1.

Each of the pixels PX arranged in the first area AR1 may display a first image IM1 by emitting light with a luminance corresponding to the data signal DS. That is, the first frame image FRAME 1 is the first image IM1 displayed based on the first image data DATA1.

Next, a method for displaying a second frame image FRAME 2 of a second frame will be described. When the image corrector 210 receives first image data DATA1 and a control signal CS from the processor 100, the frame data counter 212 may determine information that the first image data DATA1 is the second frame by using the control signal (e.g., a vertical synchronization signal), and generate frame information CI on the second frame.

When it is previously determined that an image of the second frame is reduced and shifted by a specific shift amount along a specific shift direction, the shift determiner 214 may generate shift information SI of the image, which includes the shift direction and the shift amount.

The area determiner 216 may determine a second area AR2*a* by reducing the first area AR1, based on the shift information SI of the image, and generate area information including information on the second area AR2*a*.

The image data generator 218 may generate second image data DATA2 using the first image data DATA1 such that the first image IM1 displayed in the first area AR1 is reduced in the second area AR2*a* to be displayed as a second image IM2*a*.

The image data generator 218 may supply the second image data DATA2 to the timing controller 220. The timing controller 220 may supply the second image data DATA2 to the data driver 230. The data driver 230 may provide a data signal DS generated based on the second image data DATA2 to pixels arranged in the second area AR2*a*.

Each of the pixels PX arranged in the second area AR2*a* may display the second image IM2*a* by emitting light with a luminance corresponding to the data signal DS. In this example, pixels PX arranged in the rest of the first area AR1, which does not overlap with the second area AR2*a*, may display a black image BM. That is, the second frame image FRAME 2 includes the second image IM2*a* displayed based on the second image data DATA2 and the black image BM.

Next, a method for displaying a third frame image FRAME 3 of a third frame will be described. When the image corrector 210 receives first image data DATA1 and a control signal CS from the processor 100, the frame data counter 212 may determine information that the first image data DATA1 is the third frame by using the control signal (e.g., a vertical synchronization), and generate frame information CI on the third frame.

When it is previously determined that an image of the third frame is reduced and shifted by a specific shift amount along a specific shift direction, the shift determiner 214 may generate shift information SI of the image, which includes the shift direction and the shift amount.

In this example, the shift information SI of the image of the third frame includes information different from the shift information SI of the image of the second frame. That is, in order to differently determine sizes of second areas for every frame, the shift determiner 214 generates the shift information SI of the image, which includes information different from that of the previous frame.

The area determiner 216 may determine a second area AR2*b* by reducing the first area AR1 based on the shift information SI of the image, and generate area information including information on the second area AR2*b*. In this example, the second area AR2*b* determined in the third frame has a different size from the second area AR2*a* determined in the second frame.

The image data generator 218 may generate second image data DATA2 using the first image data DATA1 such that the first image IM1 displayed in the first area AR1 is reduced to be displayed in the second area AR2*b* as a second image IM2*b*.

The image data generator 218 may supply the second image data DATA2 to the timing controller 220. The timing controller 220 may supply the second image data DATA2 to the data driver 230. The data driver 230 may provide a data signal DS generated based on the second image data DATA2 to pixels PX arranged in the second area AR2*b*.

Each of the pixels PX arranged in the second area AR2*b* may display the second image IM2*b* by emitting light with a luminance corresponding to the data signal DS. In this example, pixels PX arranged in the rest of the first area AR1 that do not overlap with the second area AR2*b* may display a black image BM. That is, the third frame image FRAME 3 includes the second image IM2*b* displayed based on the second image data DATA2 and the black image BM.

In this manner, the pixels PX may display a fourth frame image FRAME 4 of a fourth frame and a fifth frame image FRAME 5 of a fifth frame, and the area (first area AR1 or second area AR2*a* to AR2*c*) in which an image is displayed and the area (area in which the first area AR1 and the second area AR2*a* to AR2*c* do not overlap with each other) in which the black image BM is displayed may be changed for every frame.

According to an embodiment of the present disclosure, the area determiner 216 can differently determine the size of the second area AR2*a* to AR2*c* for every frame. Hence, it is possible to shift an image fixedly displayed in a specific area (e.g., the area in which the black image BM is displayed in the second frame image FRAME 2).

Also, according to an embodiment of the present disclosure, the area determiner 216 can shift an image fixedly displayed in a specific area (e.g., the area in which the black image BM is displayed in the second frame image FRAME 2) by determining the second area AR2*a* to AR2*c* such that some of the corners surrounding the second area AR2*a* to AR2*c* overlap with some of the corners surrounding the first area AR1. Accordingly, it is possible to effectively prevent the generation of an afterimage in the specific area.

Figure 6:
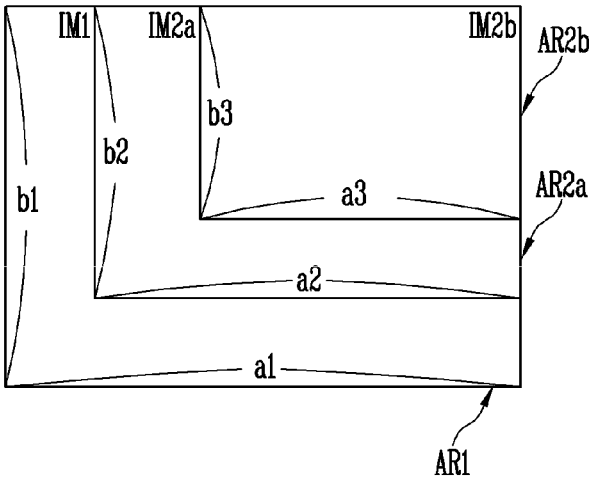
FIG. 6 is a conceptual diagram illustrating a rate of reduction between first and second images according to the embodiment of the present disclosure.
Figure 7A:
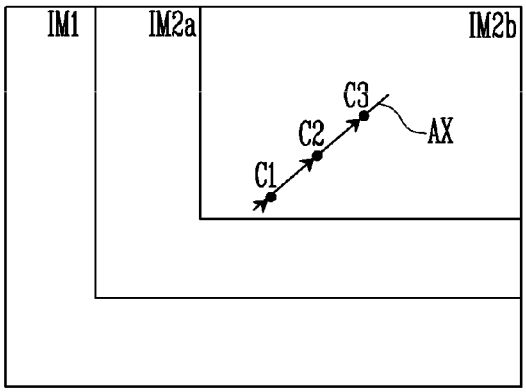
FIGS. 7A and 7B are conceptual diagrams illustrating a process in which the centers of the first and second images are shifted corresponding to the rate of reduction.

FIG. 6 is a conceptual diagram illustrating a rate of reduction between the first and second images according to the embodiment of the present disclosure. FIGS. 7A and 7 are conceptual diagrams illustrating a process in which the centers of the first and second images are shifted corresponding to the rate of reduction.

Referring to FIG. 6, the first image IM1 of the first frame, the second image IM2*a* of the second frame, and the second image IM2*b* of the third frame are illustrated.

When the first area AR1 in which the first image IM1 is displayed, the second area AR2*a* in which the second image IM2*a* is displayed, and the second area AR2*b* in which the second image IM2*b* is displayed have quadrangular shapes, the ratios of each of lateral lengths a1, a2, and a3 to respective longitudinal lengths b1, b2, and b3 of the respective first, second, and second areas AR1, AR2*a*, and AR2*b* may be equal to or different from one another.

Referring to FIG. 7A, when the ratio of the lateral length a1 to the longitudinal length b1 of the first area AR1, the ratio of the lateral length a2 to the longitudinal length b2 of the second area AR2*a*, and the ratio of the lateral length a3 to the longitudinal length b3 of the second area AR2*b* are equal to one another, shifts of the centers of the images corresponding to shifts of the images are illustrated.

The center C1 of the first image IM1 of the first frame, the center C2 of the second image IM2*a* of the second frame, and the center C3 of the second image IM2*b* of the third frame may be formed on the same linear axis AX. That is, the centers of the first area AR1, the second area AR2*a*, and the second area AR2*b* may be formed on the same linear axis AX.

Therefore, the images of the respective frames may be shifted along the same direction (linear axis direction).

Figure 7B:
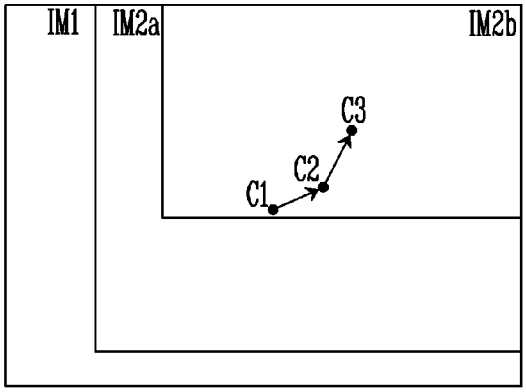

Referring to FIG. 7B, when the ratio of the lateral length a1 to the longitudinal length b1 of the first area AR1, the ratio of the lateral length a2 to the longitudinal length b2 of the second area AR2*a*, and the ratio of the lateral length a3 to the longitudinal length b3 of the second area AR2*b* are different from one another, shifts of the centers of the images corresponding to shifts of the images are illustrated.

The center C1 of the first image IM1 of the first frame, the center C2 of the second image IM2*a* of the second frame, and the center C3 of the second image IM2*b* of the third frame are not formed on the same linear axis. That is, the centers of the first area AR1, the second area AR2*a*, and the second area AR2*b* are not formed on the same linear axis. Therefore, the images of the respective frames may be shifted along directions different from one another.

Figure 8:
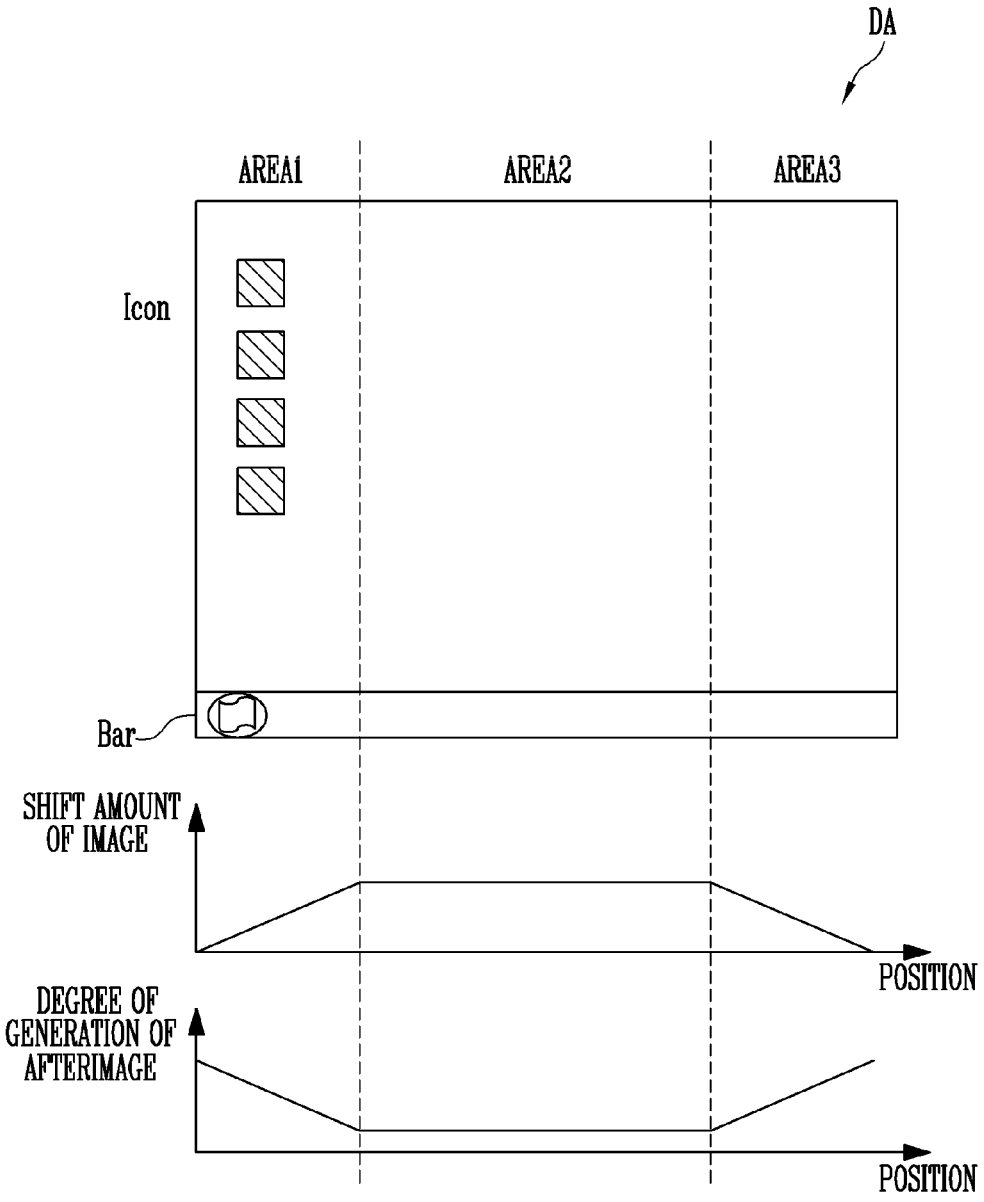
FIG. 8 is a conceptual diagram illustrating the generation of an afterimage is suppressed by a display device according to another embodiment of the present disclosure.

FIG. 8 is a conceptual diagram illustrating the generation of an afterimage is suppressed by a display device according to another embodiment of the present disclosure.

Referring to FIG. 8, an image of an operating system of the display device 10 is displayed in an image display area DA. The image may be divided into a first display area AREA1, a second display area AREA2, and a third display area AREA3.

Icons Icon are displayed in the first display area AREA1, and a menu bar Bar is displayed at a lower end portion of the image. Generally, the icons Icon and the menu bar Bar are frequently fixedly displayed on the image display area DA without any change, and hence many afterimages may be generated in the first display area AREA1 as compared with the second display area AREA2 in which the icons Icon are not arranged. In addition, the third display area AREA3 may not be frequently used by a user as compared with the second display area AREA2, and hence many afterimages may be generated in the third display area AREA3 as compared with the second display area AREA2.

In order to suppress the generation of an afterimage, the display device 10 according to the another embodiment of the present disclosure may set, as a fixed area, an area in which the shift amount of an image is small, such as the first display area AREA1 or the third display area AREA3, and may determine, as a second area, at least a partial area of the image display area DA except the fixed area.

In some embodiments, the display device 10 may set, as a fixed area, an area having no change in image by comparing an image of a current frame with an image of a previous frame.

As described above, the display device 10 according to the another embodiment of the present disclosure displays the black image BM in an area set as a fixed area, and reduces the existing displayed image to be displayed in the other area except the fixed area in the image display area, so that it is possible to suppress the generation of an afterimage in the fixed area.

In FIG. 8, the first to third display areas AREA1 to AREA3 are exemplarily described to describe a method for suppressing the generation of an after image as the display device 10 according to the another embodiment of the present disclosure sets a fixed area. However, the present disclosure is not limited thereto.

Figure 9:
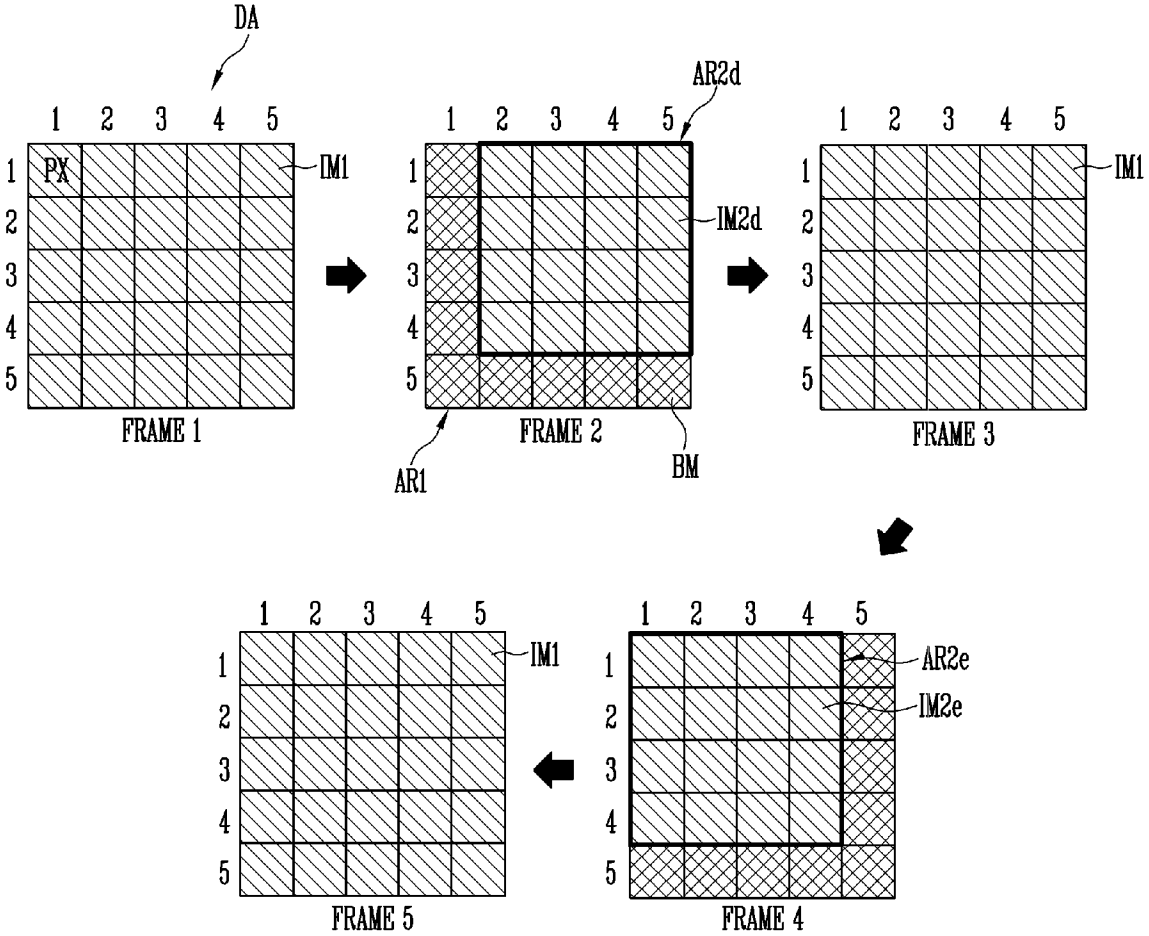
FIG. 9 is a conceptual diagram illustrating a method for displaying an image using a display device according to still another embodiment of the present disclosure.

FIG. 9 is a conceptual diagram illustrating a method for displaying an image using a display device according to still another embodiment of the present disclosure.

The method for displaying an image using the display device 10, shown in FIG. 9, is similar to the method for displaying an image using the display device 10, described in FIG. 5, and therefore, overlapping descriptions will be omitted.

Referring to FIG. 9, there are illustrated frame images FRAME 1 to FRAME 5 sequentially displayed in an image display area DA. Each of the frame images FRAME 1 to FRAME 5 is displayed corresponding to a data signal DS generated based on first image data DATA1 or second image DATA2.

First, when it is previously determined that an image of a first frame is not shifted, the display device 10 may display a first image IM1 in the entire image display area DA using the data signal DS generated based on the first image data DATA1. Therefore, a first frame image FRAME 1 is the first image IM1 displayed based on the first image data DATA1.

In addition, when it is previously determined that an image of a second frame is reduced and shifted by a specific shift amount along a specific shift direction, the display device 10 may determine a second area AR2*d*, corresponding to the shift direction and the shift amount, and display a second image IM2*d* in the second area AR2*d* using the data signal DS generated based on the second image data DATA2. In this case, a black image BM may be displayed in the rest of a first area AR1, which does not overlap with the second area AR2*d*. Therefore, a second frame image FRAME 2 includes the second image IM2*d* and the black image BM.

In addition, when it is previously determined that an image of a third frame is not shifted, the display device 10 may display the first image IM1 in the entire image display area DA using the data signal DS generated based on the first image data DATA1. Therefore, a third frame image FRAME 3 is the first image IM1 displayed based on the first image data DATA1.

In addition, when it is previously determined that an image of a fourth frame is shifted along a shift direction and a shift amount, which are different from the shift direction and the shift amount defined in the second frame, the display device 10 may determine a second area AR2*e* corresponding to the shift direction and the shift amount which are different from the shift direction and the shift amount defined in the second frame, and the display device 10 may display a second image IM2*e* in the second area AR2*e* using the data signal DS generated based on the second image data DATA2. In this case, the black image BM may be displayed in the rest of the first area AR1, which does not overlap with the second area AR2*e*. Therefore, a fourth frame image FRAME 4 includes the second image IM2*e* and the black image BM.

As described above, when there exists a plurality of areas in which an afterimage is generated, the display device 10 according to the still another embodiment of the present disclosure periodically changes the area in which the black image BM is displayed, so that it is possible to effectively suppress the generation of the afterimage.

Figure 10:
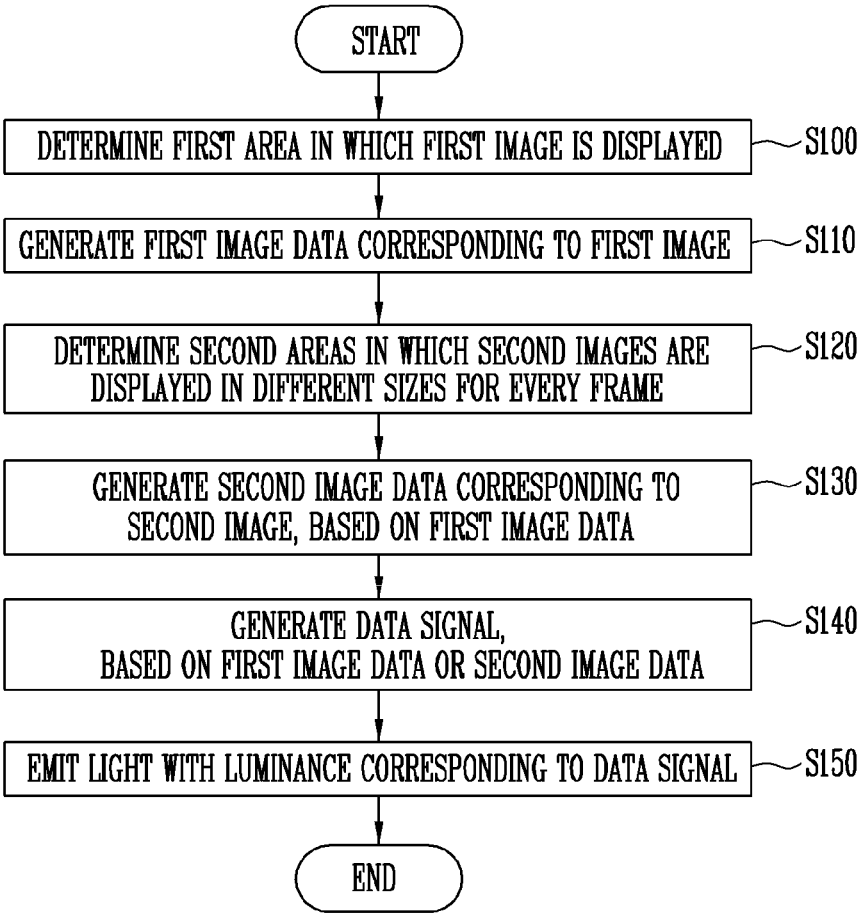
FIG. 10 is a flowchart illustrating a method for displaying an image using a display device according to an embodiment of the present disclosure.

FIG. 10 is a flowchart illustrating a method for displaying an image using a display device according to an embodiment of the present disclosure.

Referring to FIG. 10, the display device 10 according to the embodiment of the present disclosure may determine a first area in which a first image is displayed (S100), and generate first image data DATA1 corresponding to the first image (S110).

Then, the display device 10 may determine second areas in which second images are displayed in different sizes for every frame (S120).

Then, the display device 10 may generate second image data DATA2 corresponding to the second image, based on the first image data DATA1 (S130).

Then, the display device 10 may generate a data signal DS, based on the first image data DATA1 or the second image data DATA2 (S140).

Then, the display device 10 allows pixels PX to emit light with a luminance corresponding to the data signal DS (S150).

According to the display device and the method for displaying an image using the same of the present disclosure, the sizes of second areas are differently determined for every frame, so that an image fixedly displayed in a specific area can be periodically shifted. Accordingly, it is possible to effectively prevent the generation of an afterimage in the specific area.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A method for displaying an image using a display device, the method comprising:

generating first image data corresponding to a first image displayed in a first area in an image display area;

differently determining the size of a second area in which a second image is displayed corresponding to shift information of a preset image;

generating second image data corresponding to the second image, based on the first image data so that the first image is reduced and shifted to the second area to be displayed as the second image;

generating a data signal, based on the first image data or the second image data; and emitting light with a luminance corresponding to the data signal.

2. The method of claim 1, wherein in differently determining the size of the second area, the second area is determined such that the first image is shifted to the second image, the shifting of the first image corresponding to a shift amount and a shift direction of an image included in the shift information.

3. The method of claim 2, wherein in differently determining the size of the second area, the second area is determined such that a center of the first area and a center of the second area are formed on a same linear axis.

4. The method of claim 1, wherein the first area has a larger size than the second area.

5. The method of claim 1, wherein a portion of the first area overlaps with the second area.

6. The method of claim 5, wherein a black image is displayed in an area of the first area, which does not overlap with the second area.

7. The method of claim 1, wherein, when the first area and the second area have quadrangular shapes, the ratios of lateral lengths to longitudinal lengths of the respective first and second areas are equal to each other.

8. The method of claim 1, wherein, when the first area and the second area have quadrangular shapes, the ratios of lateral lengths to longitudinal lengths of the respective first and second areas are different from each other.

9. The method of claim 1, wherein some corners surrounding the first area overlap with some corners surrounding the second area.

10. The method of claim 1, further comprising setting a fixed area in the first area using the first image data.

11. The method of claim 10, wherein in differently determining the size of the second area, at least a partial area of the image display area except the fixed area is determined as the second area.

12. The method of claim 10, wherein in setting the fixed area, an area having no change in image by comparing a current frame image with a previous frame image is set as the fixed area.

13. A display device comprising:

a display panel configured to include a first area in which a first image is displayed and a second area in which a second image is displayed;

an image corrector configured to differently determine the size of the second area for every frame, and generate second image data corresponding to the second image using first image data corresponding to the first image so that the first image is reduced and shifted to the second area to be displayed as the second image; and a data driver configured to generate a data signal, based on the first image data and the second image data.

14. The display device of claim 13, wherein the image corrector includes:

a frame data counter configured to count a number of input times of frames;

a shift determiner configured to determine a shift amount and a shift direction of an image based on a preset reference such that the first image is shifted to the second image to be displayed;

an area determiner configured to determine the first area and determine the second area corresponding to the shift amount and the shift direction of the image; and an image data generator configured to generate the second image data using the first image data.

15. The display device of claim 14, wherein the area determiner determines the size of the second area to be smaller than that of the first area.

16. The display device of claim 14, wherein the area determiner determines the second area such that the second area overlaps with at least a portion of the first area.

17. The display device of claim 14, wherein the area determiner determines the second area at a rate equal to that of corners surrounding the first area.

18. The display device of claim 14, wherein the area determiner determines the second area such that some corners surrounding the first area and some corners surrounding the second area overlap with each other.

19. The display device of claim 14, wherein the area determiner sets a fixed area in the first area using the first image data, and determines, as the second area, at least a partial area of an image display area except the fixed area.

20. The display device of claim 14, wherein, when the display panel receives the data signal generated based on the second image data from the data driver, a black image is displayed in a rest of the second area.

* * * * *